United States Patent [19]

Loughmiller

[11] 4,363,416

[45] Dec. 14, 1982

[54] WINE CORK

[75] Inventor: Bert E. Loughmiller, Benicia, Calif.

[73] Assignee: APM, Inc., Benicia, Calif.

[21] Appl. No.: 283,501

[22] Filed: Jul. 15, 1981

[51] Int. Cl.[3] ..... B65D 39/00

[52] U.S. Cl. ..... 215/364

[58] Field of Search ..... 215/364

[56] References Cited

U.S. PATENT DOCUMENTS 3,128,896 4/1964 Schnier ..... 215/364

FOREIGN PATENT DOCUMENTS 1056493 4/1959 Fed. Rep. of Germany ..... 215/364

7008749 12/1970 Netherlands ..... 215/364

*Primary Examiner*—Donald F. Norton

*Attorney, Agent, or Firm*—Robert G. Slick

[57] ABSTRACT

A two piece plastic closure is provided which is particularly adapted for still wines and which has substantially the same appearance as conventional corks made from natural materials.

1 Claim, 4 Drawing Figures

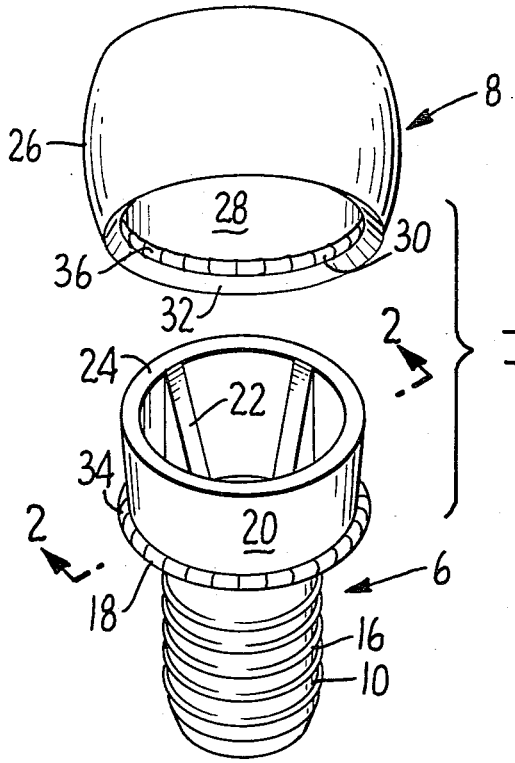
FIG. 1.
FIG. 2.
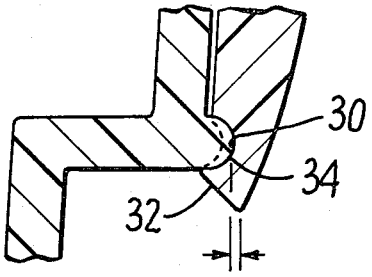
FIG. 4.
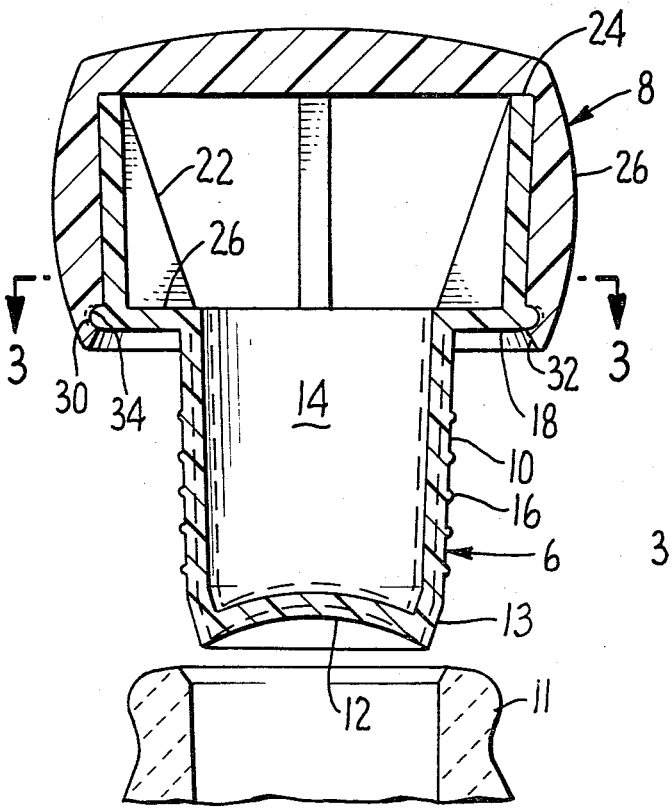
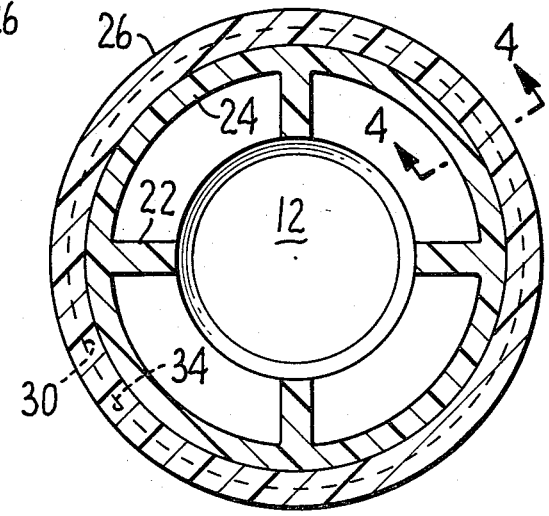
FIG. 3.

WINE CORK

SUMMARY OF THE INVENTION

The present invention relates to a wine cork which is particularly adapted for use with still wines. The cork is fabricated from two pieces of plastic of different colors and the colors are normally selected so that the cork simulates the conventional covered cork made of natural material. In the past, plastic corks have normally been associated with relatively inexpensive wines but the cork of the present invention is so attractive that it can be used with the most expensive wines. The cork of the present invention has a positive sealing system so that it is not ordinarily necessary to keep the bottle on its side to maintain a wet cork as must be done with corks of natural material.

Although the cork of the present invention is made of two pieces, they are snapped together in such a way that the two pieces will not rotate relative to each other, facilitating pulling the cork out of the bottle. This is done without the use of adhesives. Further, the two pieces of the cork are engaged throughout a substantial portion of their length, including almost the entire height of the cap portion, producing a very stable structure. The top will not rock with respect to the bottom. Further stability is achieved by providing a plurality of buttresses within the hollow body of the top of the plug portion.

The cork of the present invention so nearly simulates a standard bottle cork that it can be used with standard bottling equipment without modifying the equipment.

Various other features and advantages of the invention will be brought out in the balance of the specification.

BRIEF DESCRIPTION OF THE DRAWINGS

FIG. 1 is an exploded perspective view of the two piece cork of the present invention.

FIG. 2 is an enlarged section on the line 2—2 of FIG. 1.

FIG. 3 is a section on the line 3—3 of FIG. 2.

FIG. 4 is an enlarged partial section on the line 4—4 of FIG. 3.

DESCRIPTION OF THE PREFERRED EMBODIMENT

Referring now to the drawings by reference characters, the two piece wine cork of the present invention consists of a bottom portion generally designated 6 and an upper portion generally designated 8. The bottom portion includes a cylindrical plug portion 10 having a closed bottom 12 and a hollow interior 14. Obviously, the plug portion is selected of such size as to fit snuggly within the neck of a standard wine bottle. The plug has a plurality of circumferential ridges 16 thereon, to insure a good seal in the neck of the bottle. Since the bottom of the plug portion is sealed by the member 12, the wine never comes into contact with the hollow interior of the plug.

The closed bottom portion 12 is arched as shown which facilitates uniform compression of the plug without localized deforming of the sides or end (such as a crease or wrinkle) thus avoiding leakage. The compressed configuration of the plug is shown in dash lines in FIG. 2.

The bottom of the plug is tapered as at 13 to facilitate inserting the plug in bottles 11 of smaller diameter.

Located above the plug portion and formed integrally therewith, is a flat circular rim portion 18 and somewhat larger diameter than the plug.

Formed within the cylindrical shoulder are a series of triangular buttress members 22. These extend from the top 24 of the cylindrical shoulder to the inner surface 26 of rim 18.

The top portion 8 has a gently rounded outer surface 28 which gives a pleasing affect. The interior surface 28 of the top is cylindrical and is complementary both in diameter and in height to the cylindrical shoulder 20. Thus, the top when it is snapped into position as is later described, is held securely against wobbling both by contact with the side wall of the cylinder 20 and the top edge of the cylinder 24 as is best seen in FIG. 2. Near the bottom of the inner surface 28, a groove 30 is formed and the terminal edge of the cap is wedge shaped as at 32 so that the top snaps over the bottom portion with the rim 18 engaged in the groove 30. The rim 18 and the groove 30 have complementary ridges and depressions as at 34 and 36 which prevent the parts from rotating relative to each other. This is important since wine bottles are ordinarily opened by grasping the top and twisting it.

Preferably the top 8 and the plug portion 6 are made in contrasting colors to have an attractive appearance and to simulate conventional corks having a natural cork plug and a decorative top of wood or plastic.

The top of the present invention is very stable which is brought about by the large area of contact between the outer surface 20 of the cylindrical portion and the inner surface 28 of the top as well as a direct contact with the top of the cylinder within the interior surface of the top. Thus, the cork of the present invention merely snaps together so that it is not necessary to use any adhesive yet it is extremely strong so that it can be twisted or rocked back and forth without displacing the parts from each other. The interior buttress members 22 give great rigidity to the structure, allowing reduction in weight as well as a reduction in plastic.

The subject matter to be claimed:

1. A two piece wine cork comprising in combination:

a. a bottom portion, said bottom portion having a plug portion of a size to fit into a wine bottle, said plug portion having a hollow interior and a closed bottom and having a plurality of circumferential ridges thereon, a flat rim portion extending outwardly from the top of said plug portion and a cylindrical upstanding shoulder above said rim, said shoulder being smaller in diameter than said rim and being larger in diameter than said plug portion, and a plurality of radial buttress elements within said shoulder, starting at the top of said shoulder and sloping inwardly and downwardly to connect with the inner surface of said rim, b. a top portion fitting over said shoulder having a curved outer surface of pleasing design and a cylindrical inner surface complementary to said shoulder to form a tight fit with said shoulder, both at the top and sides, c. a groove on the inside of said top portion near the bottom terminal edge adapted to snap over said rim and hold the two parts together and, d. mating radial ridges and depressions on said rim and said groove to prevent the two parts from turning relative to each other.

* * * * *